US011192616B2

(12) United States Patent
Zijlmans et al.

(10) Patent No.: US 11,192,616 B2
(45) Date of Patent: Dec. 7, 2021

(54) DEVICE FOR TRANSFERRING PERSONNEL AND/OR GOODS FROM A SURFACE VESSEL TO AN OFFSHORE STRUCTURE OR TO ANOTHER VESSEL

(71) Applicant: IHC HOLLAND IE B.V., Sliedricht (NL)

(72) Inventors: Jurgen Arjan Zijlmans, Barendrecht (NL); Albertus Knol, Numansdorp (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 0 days.

(21) Appl. No.: 16/652,616

(22) PCT Filed: Oct. 10, 2018

(86) PCT No.: PCT/NL2018/050668
§ 371 (c)(1),
(2) Date: Mar. 31, 2020

(87) PCT Pub. No.: WO2019/074365
PCT Pub. Date: Apr. 18, 2019

(65) Prior Publication Data

US 2020/0239111 A1 Jul. 30, 2020

(30) Foreign Application Priority Data

Oct. 10, 2017 (NL) ..... 2019699

(51) Int. Cl.
*B63B 27/00* (2006.01)
*B63B 27/14* (2006.01)

(52) U.S. Cl.
CPC ..... *B63B 27/143* (2013.01); *B63B 2027/141* (2013.01)

(58) Field of Classification Search
CPC .. B63B 27/143; B63B 2027/141; E01D 15/00
(Continued)

(56) References Cited

U.S. PATENT DOCUMENTS 4,011,615 A 3/1977 Maxson et al.
4,366,591 A 1/1983 Zimmerman
(Continued)

FOREIGN PATENT DOCUMENTS

CN 105460170 A 4/2016
JP S60166583 A 8/1985
(Continued)

OTHER PUBLICATIONS

International Search Report dated Feb. 12, 2019, for corresponding International Patent Application No. PCT/NL2018/050668, filed Oct. 10, 2018.
(Continued)

*Primary Examiner* — Raymond W Addie
(74) *Attorney, Agent, or Firm* — Steven M. Koehler; Westman, Chamlin & Koehler, P.A.

(57) ABSTRACT

A device, such as a gangway, for transferring personnel and/or goods from a surface vessel to a fixed or floating structure, e.g. an offshore structure, such as a wind turbine, or to another vessel, the device comprising first and second telescoping elements and an intermediate platform for bridging the transition between the first and second telescoping elements, which platform is movable relative to both telescoping elements.

18 Claims, 2 Drawing Sheets

(58) Field of Classification Search
USPC ..... 14/69.5–72.5
See application file for complete search history.

(56) References Cited

U.S. PATENT DOCUMENTS

| | | | | |
|---|---|---|---|---|
| 4,473,916 | A | 10/1984 | Connold | |
| 7,900,307 | B2 * | 3/2011 | Okahira | B64F 1/305 14/71.5 |
| 8,959,694 | B2 * | 2/2015 | Clarke | E01D 15/08 14/71.3 |
| 9,090,359 | B2 * | 7/2015 | Wada | B64F 1/305 |
| 9,278,736 | B2 | 3/2016 | Van Der Tempel et al. | |
| 9,663,195 | B2 | 5/2017 | Van Der Tempel et al. | |
| 2013/0212812 | A1 | 8/2013 | Van Der Tempel et al. | |
| 2013/0228110 | A1 * | 9/2013 | Rohden | B63B 27/14 114/39.3 |
| 2013/0283550 | A1 | 10/2013 | Clarke | |
| 2016/0068236 | A1 | 3/2016 | Van Der Tempel et al. | |
| 2018/0155885 | A1 * | 6/2018 | Hessels | E01D 15/127 |

FOREIGN PATENT DOCUMENTS

| | | | |
|---|---|---|---|
| NL | 1033767 | C2 | 10/2008 |
| NL | 2015438 | A | 11/2016 |
| WO | 8201729 | A1 | 5/1982 |
| WO | 02120343 | A1 | 3/2002 |
| WO | 2012021062 | A1 | 2/2012 |

OTHER PUBLICATIONS

Written Opinion of the International Searching Authority dated Feb. 12, 2019, for corresponding International Patent Application No. PCT/NL2018/050668, filed Oct. 10, 2018.

Office Action in corresponding Chinese Patent Application No. 201880065619.7 dated Sep. 29, 2021.

* cited by examiner

DEVICE FOR TRANSFERRING PERSONNEL AND/OR GOODS FROM A SURFACE VESSEL TO AN OFFSHORE STRUCTURE OR TO ANOTHER VESSEL

CROSS-REFERENCE TO RELATED APPLICATION

The present application is a national stage of and claims priority of International patent application Serial No. PCT/NL2018/050668, filed Oct. 10, 2018, and published in English as WO 2019/074365.

BACKGROUND

The invention relates to a device, in particular an offshore access system, e.g. a gangway, passageway, walkway, transfer system, et cetera, for transferring personnel and/or goods, such as equipment and/or structural elements, from a surface vessel to a fixed or floating structure, e.g. an offshore structure, such as a wind turbine, or to another vessel, the device comprising first and second telescoping elements. The invention further relates to a vessel comprising such a device.

Offshore access systems, such as gangways, are used e.g. for transfer of personnel from ships to fixed or floating platforms and to other ships.

WO 02/20343, for instance, discloses a vessel provided with a telescopingly extendable gang plank mounted thereon for movement about a vertical axis.

With smaller ships and/or during rough weather, relative motion becomes more pronounced and telescoping speeds of the gangway increase. Often, the telescoping movement of the gangway is a limiting factor for safe transfer, i.e. the in- and out-sliding gangway is a potential safety hazard for personnel and/or goods, e.g. cargo in trolleys, on the gangway.

SUMMARY

An aspect of the present invention provides an improved transferring device, in particular to improve safety of personnel and/or goods on the transferring device.

The device is characterized by an intermediate platform for bridging the transition between the first and second telescoping elements, which platform is movable relative to both telescoping elements.

In an embodiment, the platform is movable backwards and forwards over the transition.

In another embodiment, the device comprises a controller configured to control the movement of the intermediate platform relative to the movement of at least one of the telescoping elements, preferably such that it correlates with the movement of at least one of the telescoping elements and/or such that, at least during transfer of personnel and/or goods, the platform is maintained (kept) over the transition.

In a refinement, the movement of the platform is proportional, preferably by a factor in a range from 0.3 to 0.7, e.g. 0.5, to the relative movement of the telescoping elements.

For instance, when the first element is fixed, e.g. by means of a foundation, to a vessel and the second element is fixed, e.g. by means of one or more grippers or by thrusting, to an offshore structure, and the telescoping speed of the second element relative to the first element is Vt, the reciprocating movement of the platform is controlled at a speed Vp that equals 0.5 Vt. Thus, compared to a device without an intermediate platform, the device according to the present invention comprises two transitions at half the telescoping speed, improving overall safety.

In another embodiment, at least during transfer of personnel and/or goods, the platform is movable backwards and forwards from one end of the device the other end, e.g. the platform is used to shuttle between the surface vessel and a fixed structure.

In a refinement, the controller is configured to control the movement of the intermediate platform such that it successively correlates with the movement of one of the telescoping elements, e.g. is locked to that element and at one end of e.g. a gangway, moves towards the other telescoping element, and correlates with the movement of the other telescoping element, e.g. is locked to that element and at the other end of the gangway.

Thus, the intermediate platform can be used as a shuttle, for example with gates and/or lights, allowing personnel and/or goods to access and leave the platform at zero speed at either end, even when telescoping speeds are high.

In another embodiment, the controller is configured to control the movement of the intermediate platform, when it moves from one of the telescoping elements to the other, following a mathematical function defined at least on the basis of the movement of one of the telescoping parts relative to the other. In an embodiment, the function is implemented by a real time algorithm.

If f(t), g(t), where t is time, are class C^n functions (i.e., functions having an n-th order derivative that is continuous) describing the (measured) position values of the fixed part and the telescoping part, then a class C^n algorithm computes a class C^n function h(t), that describes the required position of the intermediate platform. This function h(t) meets the following requirements (the actual transition takes place in the interval (t1', t2'), however to obtain the required behavior at t1' and t2' a slightly larger interval (t1, t2) is employed):

for $t1<t\leq t1'$: $h(t)=f(t)$ for $t2'\leq t<t2$: $h(t)=g(t)$

Since the algorithm runs in real time, it is causal, i.e. h(t0) does not depend on values of f(t) and g(t) for t>t0.

A suitable class C^2 function is:

$$h(t)=(1-\theta(t-t1'))\geq f(t)+\theta(t-t1')\cdot g(t),$$

where:

for $t\leq 0$, $\theta(t)=0$ for $0<t<t2'-t1'=t\theta$, $\theta(t)=(t^3/t\theta^5)\cdot(F1\cdot t\theta^2+F2\cdot t\cdot t\theta+F3\cdot t\theta^2)$, where F1, F2, and F3 are constants to ensure class C^2 behavior at t1' and t2', and for $t\geq t2'-t1'$, $\theta(t)=1$ To reduce or prevent shocks during the transition of the platform from one telescoping element to the other, it is preferred that the second derivative of the function is continuous, i.e. a class C^2 function is indicated.

To also reduce or prevent jerks during the transition of the platform from one telescoping element to the other, it is preferred that the third derivative of the function is continuous, i.e. a class C^3 function is indicated.

Typically, the intermediate platform is driven in the longitudinal direction of the device, such as a gangway, preferably by a dedicated drive system and preferably independent of the telescoping drive system but coupled to the control system of the telescoping drive system.

Typically, the controller comprises a processor and a memory and is configured, e.g. programmed, to receive data on the relative movement of the telescoping elements e.g. from the telescoping drive system or from a separate sensor, to process such data, and to operate one or more drivers that move the intermediate platform. For instance, the device may comprises a position transmitter, that measures the position of the telescoping element relative to the "fixed" element. In addition, to improve accuracy, the device may comprise a position transmitter that measures the position of the intermediate platform relative to the "fixed" element. Other possibilities include, but are not limited to, additional measurement of relative speeds and/or a Motion Reference Unit to determine the relative positions.

In general, the controller may be implemented in the form of any system including a processor and a memory that is capable of performing the functions described in this specification. Further, the controller may be coupled to one or more input/output (I/O) devices. Examples of input devices may include, but are not limited to, a lever, one or more buttons, a (small) keyboard, or the like. Examples of output devices may include, but are not limited to, a monitor or a display, speakers, or the like. Input and/or output devices may be coupled to the data processing system either directly or through intervening I/O controllers.

In an embodiment, the device comprises a driver, e.g. a hydraulic ram, belt and pulley, wire rope and sheave, chain and sprocket or rack and pinion, for moving the intermediate platform relative to both telescoping elements.

In general, it is preferred that one end of the device is pivotally connected to a foundation mounted or to be mounted on a surface vessel and the free end of the device is provided with one or more grippers for coupling the device, positively or through friction, to an offshore structure or (other) vessel. It is further preferred that the device comprises a system for actively compensating for the motions of the vessel at least during the coupling of the device to an offshore structure or to another vessel.

To reduce power consumption, in an embodiment, compensation is switched to idle when the arm is coupled to the offshore structure. I.e., after coupling, the distal end of the arm (at the coupling) relates to the offshore structure and the proximal end of the arm (at the foundation) and the vessel move freely with respect to said structure.

The invention further relates to a surface vessel comprising a device as described above for transferring personnel and/or goods from the vessel to an offshore structure or to another vessel.

BRIEF DESCRIPTION OF THE DRAWINGS

The invention will now be explained in more detail with reference to the drawings, which schematically show embodiments of the device according to the present invention.

DETAILED DESCRIPTION OF THE ILLUSTRATIVE EMBODIMENTS

Elements that are identical or performing substantially the same function are denoted by the same numeral.

Figure 1:
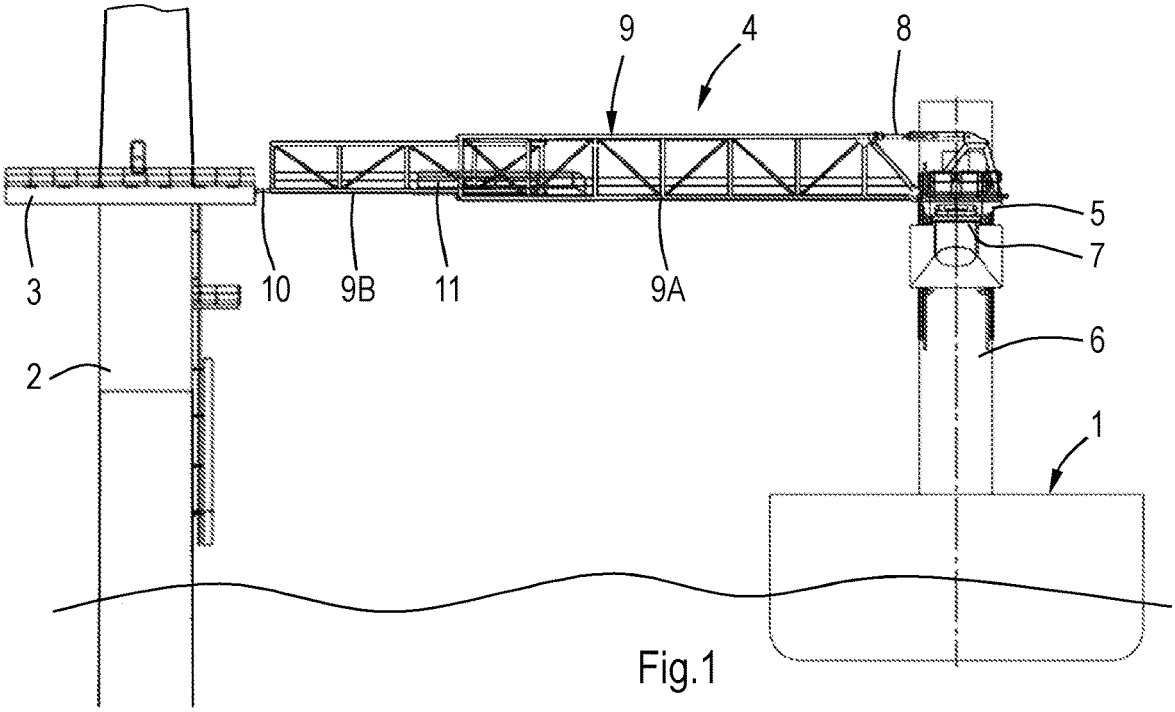
FIG. 1 is side view of an example of a transferring device tion.
Figure 2:
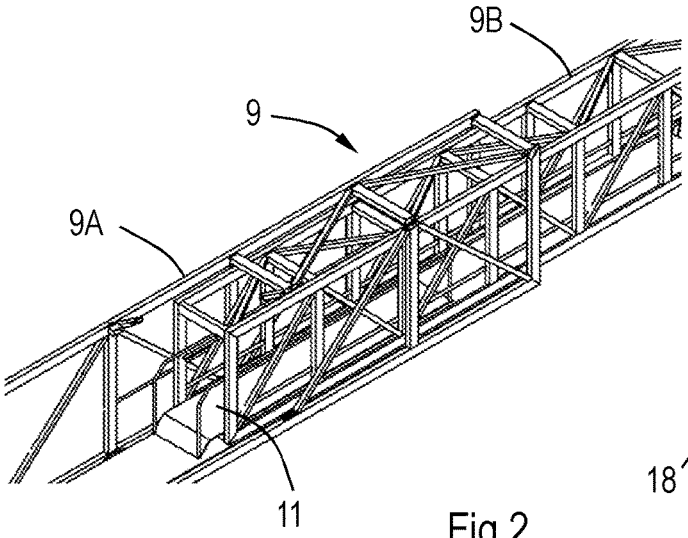
FIG. 2 is a detailed perspective view of a telescoping gangway comprising an intermediate.

FIG. 1 shows a service vessel 1 maneuvered alongside a fixed offshore structure, in this example a wind turbine 2 comprising a platform 3. The vessel carries a gangway 4 for transferring personnel and/or goods from the surface vessel 2 to an offshore structure.

The gangway 4 comprises a base frame 5, mounted in this example on a pedestal mast 6 via a slewing bearing 7. The gangway further comprises so-called luffing actuators 8, a gangway boom 9 in turn comprising first and second telescoping elements 9A, 9B and connected with its fixed end to the base frame 5. The free end of the gangway boom 9 carries a landing platform 10.

The gangway boom 9 is provided with an intermediate platform 11 that bridges the transition between the first and second telescoping elements 9A, 9B. The platform 11 is movable, in particular slidable, backwards and forwards relative to both telescoping elements 9A, 9B and over the transition. The platform can be, for instance, a plate, e.g. a tread plate, optionally provided with side walls or railings and/or a ramp 11A. It can be made of e.g. a metal, such as steel or aluminum, or another rigid material, such as a non-elastic synthetic material or even wood.

Figure 3:
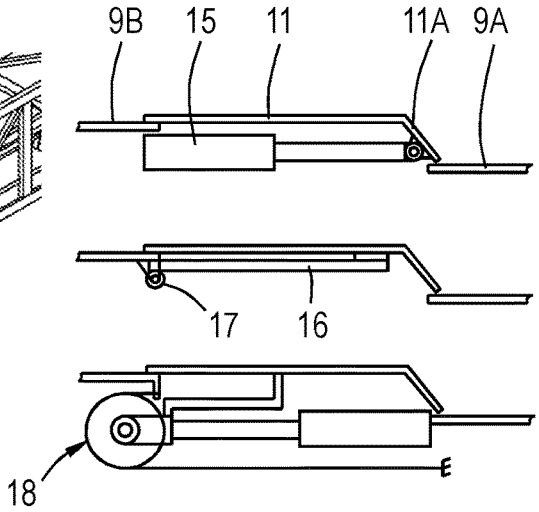
FIG. 3 contains side views of various drivers for moving the intermediate platform forwards and backwards.

The gangway comprises a driver for moving the intermediate platform relative to both telescoping elements. In this example, the driver is connected with one end to one of the telescoping elements 9A, 9B and with the other end to the platform 11. Examples of suitable drivers are shown in FIG. 3 and include a hydraulic ram 15, a rack 16 and pinion 17, and a wire rope and sheave mechanism 18.

The gangway is further provided with a controller configured to control the movement of the intermediate platform via the driver and relative to the movement of at least one of the telescoping elements.

In example shown in the Figures, the movement of the platform 11 is proportional, e.g. by a factor 0.5, to the relative movement of the telescoping elements 9A, 9B. In another example, the platform 11 is movable backwards and forwards from one end of the device to the other end, i.c. from adjacent the base frame 5 to adjacent the landing platform 10. The controller is configured to control the movement of the intermediate platform 11 such that it is, successively, fixed relative to the base frame 5, moved towards the landing platform 10 following a mathematical function, and fixed relative to landing platform 10.

Figure 4A:
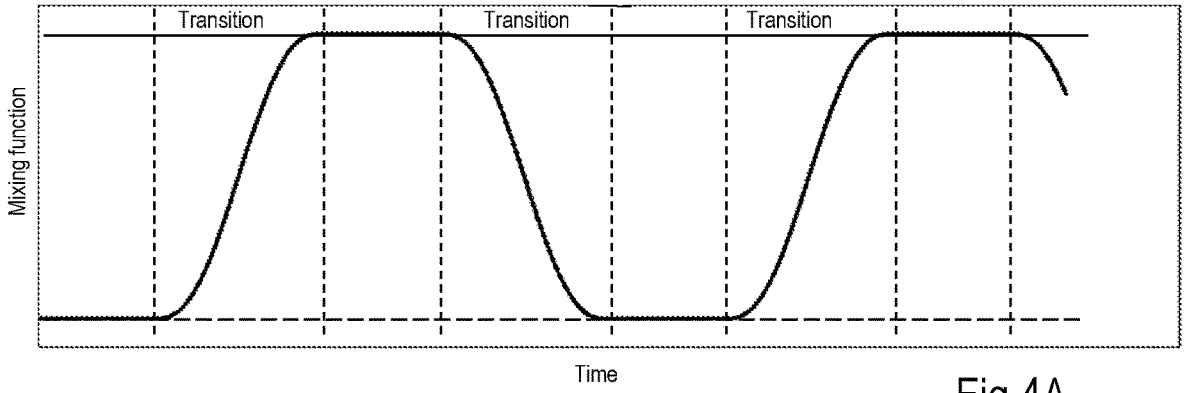
FIGS. 4A to 4D illustrating the movement of the intermediate platform relative to the telescoping gangway.
Figure 4B:
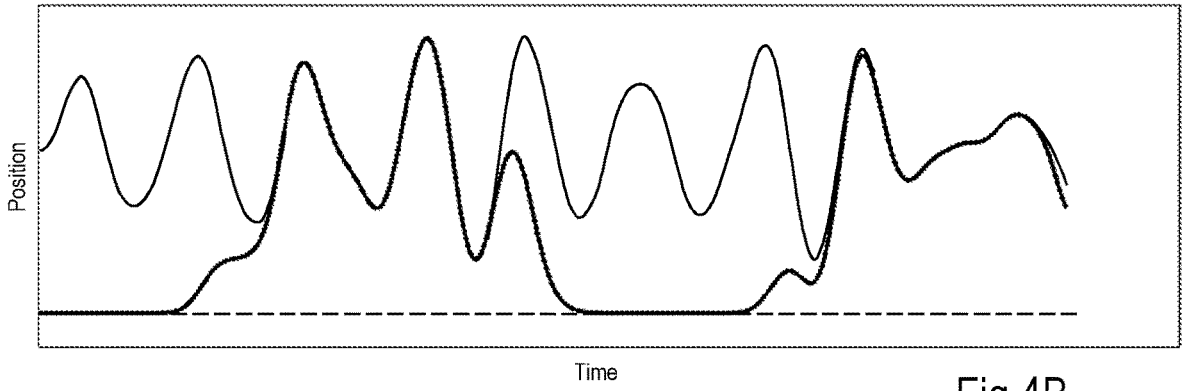
Figure 4C:
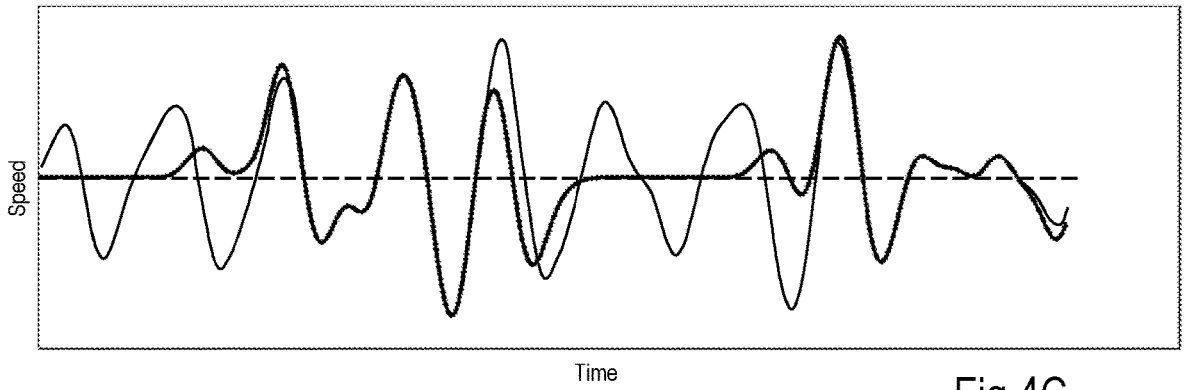
Figure 4D:
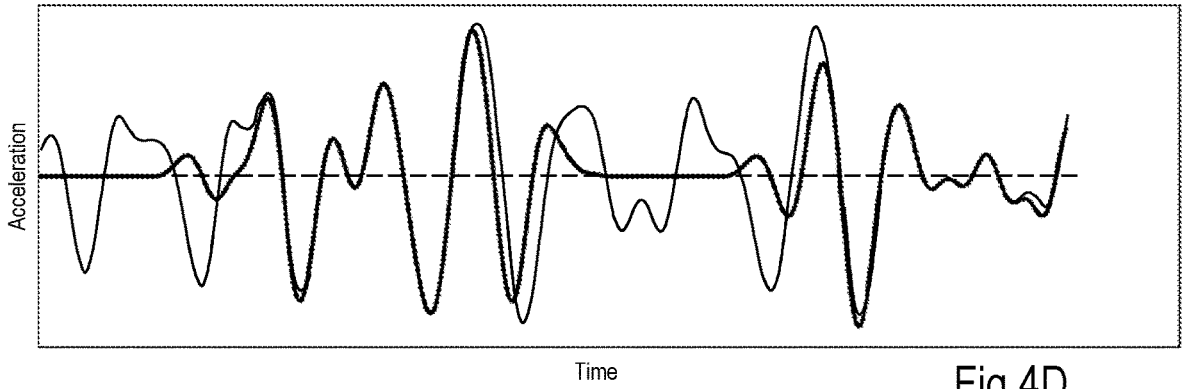

A suitable class C^3 function is:

$$h(t)=(1-\theta(t-t1'))\cdot f(t)+\theta(t-t1')\cdot g(t),$$

where:

for $t\leq 0$, $\theta(t)=0$ for $0<t<t2'-t1'=t\theta$, $\theta(t)=(t\hat{}4/t\theta\hat{}7)\cdot(35\cdot t\theta\hat{}3-84\cdot t\ t\theta\hat{}2+70\cdot t\hat{}2\cdot t\theta-20\cdot t\hat{}3)$, and for $t\geq t2'-t1'$, $\theta(t)=1$ The function, which during the transition of the platform from one of the telescoping elements to the other mathematically 'mixes' the movements of these elements, is shown in the diagram in FIG. 4A. The diagrams in FIGS. 4B, 4C, and 4D show the movements, in terms of respectively position, speed, and acceleration, of the telescoping elements and the platform, i.e. the thin straight line represents the movement of the element that is considered fixed (typically the telescoping element connected to the vessel), the thin variable line represents the movement of the element that is considered to be telescoping (typically the element connected to e.g. an offshore structure) and the thick variable line represents the movement of the platform. As is apparent from these Figures, the movement of platform is smooth (FIG. 4B), without shocks (FIG. 4C), and without jerks (FIG. 4D).

The invention is not restricted to the above-described embodiments, which can be varied in a number of ways within the scope of the claims. In an example, for increased accuracy, the controller is configured to process speed measurements in addition to position measurements. Furthermore, passed experience can be used to optimise stroke (i.e. make the stroke of the intermediate platform as short as possible) or transition time or to limit the maximum speeds and/or maximum acceleration.

The invention claimed is:

1. A device for transferring personnel and/or goods from a surface vessel to a fixed or floating structure, the device comprising a first telescoping element and a second telescoping element connected to the first telescoping element in a telescoping manner to extend from the first telescoping element, and an intermediate platform for bridging a transition between the first and second telescoping elements, which platform is movable relative to both the first and second telescoping elements.

2. The device according to claim 1, wherein the platform is movable backwards and forwards over the transition.

3. The device according to claim 1, and further comprising a driver configured to move the intermediate platform relative to both telescoping elements.

4. The device according to claim 1, wherein one end of the device is pivotally connected to a foundation configured to be mounted on a surface vessel.

5. The device according to claim 1, and further comprising a system for actively compensating for the motions of the vessel at least during the coupling of the device to an offshore structure or to another vessel, and the free end of the device is provided with one or more grippers or buffers for coupling the device to an offshore structure or other vessel.

6. The device according to claim 1, comprising a controller configured to control the movement of the intermediate platform relative to the movement of at least one of the telescoping elements.

7. The device according to claim 6, wherein the controller comprises a processor and a memory and is configured to receive data on the relative movement of the telescoping elements, to process such data and to operate one or more drivers that move the intermediate platform.

8. The device according to claim 6, wherein the controller is configured to control the movement of the intermediate platform such that the intermediate platform correlates with the movement of at least one of the telescoping elements.

9. The device according to claim 8, wherein the movement of the platform is proportional by a factor in a range from 0.3 to 0.7 to the relative movement of the telescoping elements.

10. The device according to claim 9, wherein the factor is 0.5.

11. The device according to claim 8, wherein, at least during transfer of personnel and/or goods, the platform is maintained over the transition.

12. The device according to claim 8, wherein the movement of the platform is proportional to the relative movement of the telescoping elements.

13. The device according to claim 8, wherein, at least during transfer of personnel and/or goods, the platform is movable backwards and forwards from one end of the device the other end.

14. The device according to claim 13, wherein the controller is configured to control the movement of the intermediate platform such that the intermediate platform, successively correlates with the movement of one of the telescoping elements, moves towards the other telescoping element, and correlates with the movement of the other telescoping element.

15. The device according to claim 14, wherein the controller is configured to control the movement of the intermediate platform, when the intermediate olatform it moves from one of the telescoping elements to the other on the basis of the movement of one of the telescoping parts relative to the other.

16. The device according to claim 15, wherein at least the first derivative of the function is continuous.

17. The device according to claim 16, wherein at least the first and second derivative of the function is continuous.

18. A surface vessel comprising a device for transferring personnel and/or goods from a surface vessel to a fixed or floating structure, the device comprising first and second telescoping elements and wherein an intermediate platform for bridging the transition between the first and second telescoping elements, which platform is movable relative to both telescoping elements.

* * * * *